US012782008B2

(12) United States Patent
Kelly et al.

(10) Patent No.: US 12,782,008 B2
(45) Date of Patent: Nov. 3, 2026

(54) CRYOGENIC APPARATUS

(71) Applicant: ICEOXFORD LIMITED, Witney (GB)

(72) Inventors: Paul Kelly, Witney (GB); Gergo Graf, Witney (GB)

(73) Assignee: ICEOXFORD LIMITED (GB)

( * ) Notice: Subject to any disclaimer, the term of this patent is extended or adjusted under 35 U.S.C. 154(b) by 162 days.

(21) Appl. No.: 18/029,985

(22) PCT Filed: Oct. 5, 2021

(86) PCT No.: PCT/GB2021/052565
§ 371 (c)(1),
(2) Date: Apr. 3, 2023

(87) PCT Pub. No.: WO2022/074372
PCT Pub. Date: Apr. 14, 2022

(65) Prior Publication Data
US 2023/0366589 A1 Nov. 16, 2023

(30) Foreign Application Priority Data
Oct. 6, 2020 (GB) ..... 2015839

(51) Int. Cl.
*F25B 9/00* (2006.01)
*F25B 41/40* (2021.01)

(52) U.S. Cl.
CPC ..... *F25B 9/002* (2013.01); *F25B 41/40* (2021.01); *F25B 2500/13* (2013.01)

(58) Field of Classification Search
CPC .... F25B 9/002; F25B 9/10; F25B 9/14; F25B 41/00; F25B 41/37; F25B 2500/13;
(Continued)

(56) References Cited

U.S. PATENT DOCUMENTS 3,176,473 A * 4/1965 Andonian ..... H01F 6/04 62/51.1
4,363,217 A * 12/1982 Venuti ..... F04B 37/08 62/55.5

(Continued)

FOREIGN PATENT DOCUMENTS

DE 202006010374 U1 * 11/2007 ..... F16K 5/201
EP 0720024 7/1996

(Continued)

OTHER PUBLICATIONS

Narasaki et al. (JPH1163697A) English Translation (Year: 1999).*

(Continued)

*Primary Examiner* — Elizabeth J Martin
*Assistant Examiner* — Keona Lauren Banks
(74) *Attorney, Agent, or Firm* — Onello & Mello P.C.

(57) ABSTRACT

A cryogenic apparatus comprises a first enclosure, a thermo-mechanical cooler thermally coupled to said first enclosure, and a second enclosure spatially distanced from the first enclosure. An elongate tubular link member is configured to thermally couple the first and second enclosures across the space between them. A liquid helium containing vessel is located in or proximal to said second enclosure for holding liquid helium. A connecting device is located in said first enclosure and comprises a plurality of fluidly coupled ports, wherein a first port of said connecting device is coupled, via first vibration-suppressing means, to an end of said tubular link member.

18 Claims, 12 Drawing Sheets

(58) Field of Classification Search
CPC ..... F25B 41/40; F25D 19/006; F17C 3/085; F17C 3/08
See application file for complete search history.

(56) References Cited

U.S. PATENT DOCUMENTS

| | | | | |
|---|---|---|---|---|
| 5,597,009 | A * | 1/1997 | Scherrer | F16K 51/02 62/50.7 |
| 6,062,073 | A * | 5/2000 | Patton | E21B 49/083 73/152.55 |
| 6,181,228 | B1 | 1/2001 | Laskaris et al. | |
| 8,844,298 | B2 * | 9/2014 | Woidtke | F25D 19/006 62/51.1 |
| 9,618,257 | B2 * | 4/2017 | Black | F25D 19/00 |
| 11,566,836 | B2 * | 1/2023 | Wu | F25D 19/006 |
| 2011/0219785 | A1 * | 9/2011 | Black | F17C 13/007 62/3.1 |
| 2014/0202174 | A1 | 7/2014 | Wang | |
| 2015/0337968 | A1 * | 11/2015 | Strand | B23P 15/001 251/315.01 |
| 2019/0041103 | A1 * | 2/2019 | Kelly | F25B 9/12 |
| 2020/0408457 | A1 * | 12/2020 | Wu | F25D 19/006 |

FOREIGN PATENT DOCUMENTS

| | | | | |
|---|---|---|---|---|
| EP | 0797059 | | 9/1997 | |
| JP | H1163697 | A * | 3/1999 | F28D 7/103 |
| WO | 2018172772 | | 9/2018 | |

OTHER PUBLICATIONS

Sutton, Ian. Plant Design and Operations (2nd Edition)—4.8.3 Expansion Loops/Compensators, 2017 , Elsevier, pp. 15-153. Retrieved from <https://app.knovel.com/hotlink/pdf/id:kt011D1UH2/plant-design-operations/expansion-loops-compensators>. (Year: 2017).*

Rotelmann (DE202006010374U1) English Translation (Year: 2007).*

International Search Report and Written Opinion dated Dec. 21, 2021 issued in corresponding International Application No. PCT/GB2021/052565.

Great Britain Search Report dated Mar. 23, 2021 issued in Great Britain Application No. GB2015839.0.

* cited by examiner

CRYOGENIC APPARATUS

FIELD OF THE INVENTION

This invention relates to a cryogenic apparatus, that is to say an apparatus for low-temperature refrigeration. Such apparatus may enable a specimen to be cooled to ultra-low temperatures so that measurements may be made on the properties of the specimen at such low temperatures.

BACKGROUND OF THE INVENTION

A number of different thermo-mechanical devices are known for achieving such low temperatures, for example using pressure cycling of helium gas. This may be achieved using, for example, a Gifford-McMahon cooler, wherein high-pressure helium, at a pressure typically between 10 and 30 bar, is used as the working fluid and a cylinder contains a displacer and regenerator. A mechanical valve connects the cylinder to the gas at low pressure and high pressure alternately, and the displacer is moved in synchronisation with the operation of the valve. Gas expansion takes in heat from the environment at one end of the cylinder, so one end of the cylinder may be referred to as the cold head, and is cooled to a low temperature. However, it is not always convenient to place the specimen directly in contact with the cold head of a thermo-mechanical cooler. Furthermore, a two-stage Gifford-McMahon cooler may be able to cool a specimen to a temperature as low as 4K, but it is advantageous for at least some applications to provide a further cooling stage to reach even lower temperatures relatively quickly.

WO 2018/172772 A1 describes a cryogenic apparatus in which a first stage of a two-stage Gifford-McMahon cooler is in thermal contact with a copper top plate of a cylindrical intermediate-temperature shield, which also has a base plate. The lower end of the second stage of the Gifford McMahon cooler is in thermal contact with a second, smaller copper top plate of a cylindrical low-temperature shield, which also has a base plate; the intermediate temperature shield being concentric and enclosed within (but spaced-apart from) an outer the low-temperature shield being concentric and enclosed within (but spaced-apart from) an outer cylindrical enclosure and the intermediate-temperature shield being enclosed within (but spaced-apart from) the intermediate-temperature shield. In use, the low-temperature shield is typically at about 4K. A gas flow duct extends coaxially through the low-temperature shield and leads to a concentric cylindrical vessel, enclosed within, but spaced-apart from, the low-temperature shield, and containing liquid helium (in use). The cylindrical vessel is in thermal contact with a copper (top) support plate of a cylindrical operating-temperature shield, which also has a base plate. The operating-temperature shield is typically at about 1K, in use. Perforations are provided in the top plates of the intermediate-, low- and operating-temperature shields, such that when the outer enclosure is evacuated so, too, are the above-mentioned temperature shields. In use, a specimen to be cooled is mounted within the operating-temperature shield, usually on the underside of the top support plate, and is cooled by heat conduction through the support plate to helium within the cylindrical vessel.

A specimen insertion tube or "probe" extends through the top plate of the enclosure to near the bottom of the enclosure. The specimen insertion tube has a removable lid from which extends a support rod (of poor thermal conductivity) having a specimen support plate at its bottom end, to which a specimen can be mounted.

The thermo-mechanical coolers will, in most cases, produce some vibration, whereas in many cases it is advantageous or necessary to inhibit vibration of the specimen, for example, if it is required to perform high-NA (Numerical Aperture) imaging. For this reason, the thermo-mechanical coolers may be mechanically linked to the rest of the apparatus by a vibration-suppressing linkage, such as an edge-welded bellows of stainless steel or bellows of flexible plastic material.

In the described arrangements, although the specimen does not need to be in direct contact with the cold head and additional cooling is provided to facilitate the 1K 'pot' or vessel, the 50K, 4K and 1K 'stages' are all concentric and arranged about a substantially vertical or upright axis (in use), and insertion of the specimen into the 1K pot is facilitated (from the bottom or the top, depending on the particular configuration of the apparatus) along the same axis. However, this is not always convenient, and it would be desirable to provide a cryogenic apparatus in which (at least) the operating-temperature vessel can be spaced-apart from the longitudinal axis of a cold head of a thermo-mechanical cooler, such that, for example, the operating-temperature vessel can be conveniently mounted, or otherwise supported, on a separate structure, such as an optical table, and the specimen can be mounted in the operating-vessel from the top, rather than the bottom. It would also be advantageous to provide a cryogenic apparatus wherein a specimen can be introduced into, or removed from, the operating-temperature region of a 1K pot, preferably from the top, whilst causing minimal temperature losses, thereby minimising delay and inefficiencies during use.

Aspects of the present invention seek to address at least one or more of these issues.

SUMMARY OF THE INVENTION

In accordance with an aspect of the present invention, there is provided a cryogenic apparatus comprising:

- a first enclosure;
- a thermo-mechanical cooler thermally coupled to said first enclosure;
- a second enclosure spatially distanced from the first enclosure;
- an elongate tubular link member configured to thermally couple the first and second enclosures across the space between them;
- a liquid helium containing vessel located in or proximal said second enclosure for holding liquid helium, in use;
- a liquid helium delivery assembly for delivering helium from said thermo-mechanical cooler to said liquid helium containing vessel;
- a helium gas extraction duct for carrying helium gas returned from said from said second enclosure, via said link member, to said thermo-mechanical cooler;
- a connecting device located in said first enclosure and comprising a plurality of fluidly coupled ports, wherein a first port of said connecting device is coupled, via first vibration-suppressing means, to an end of said tubular link member, a second port of said connecting device is coupled, via second vibration-suppressing means, to an end of said helium gas extraction duct, and a third port of said connecting device is coupled, via third vibration suppressing means, to a wall of said first enclosure.

The vibration-suppression means may, for example, comprise bellows.

In an embodiment, the cryogenic apparatus may comprise an outer vacuum chamber arrangement comprising a first outer chamber housing said first enclosure with a first circumferential air gap therebetween, a rigid tubular bridge member surrounding said tubular link member with a second circumferential air gap therebetween, and a second outer chamber housing said second enclosure with a third air gap therebetween, wherein the first second and third air gaps together define a fluid flow path, and wherein said thermo-mechanical cooler extends into said first outer chamber which has an evacuation port therein and the apparatus further comprises means for sealing said second outer chamber such that, in use, when air is extracted from said outer vacuum chamber arrangement via said evacuation port and said fluid flow path, a vacuum is created in said first and second enclosures.

In this case, the tubular bridge member may be coupled, via first external vibration-suppressing means, to a first port provided in the first outer chamber; and, optionally, the first outer chamber may comprise a second port and a support arm coupled, at one end via second external vibration-suppressing means, to the second port and, at the other end, to said tubular bridge member at a location along its length.

In an embodiment, the liquid helium delivery assembly may comprise at least one conduit that extends from the thermo-mechanical cooler, through said tubular link member, to said liquid helium containing vessel in said second enclosure. In this case, the liquid helium delivery assembly may comprise two substantially parallel capillaries that extend from said thermo-mechanical cooler, through said tubular link member, to said liquid helium containing vessel; and the liquid helium delivery system may, optionally, comprise a needle valve assembly between each of said capillaries and said thermo-mechanical cooler.

In an embodiment, the cryogenic apparatus may further comprise a generally cylindrical end cap having an opening at one end and being coupled at the other end, via fourth vibration suppressing means, to a fourth port of said connecting device.

In an embodiment, the thermo-mechanical cooler may comprise a two-stage thermo-mechanical cooler, wherein the first enclosure is coupled to a first stage if the thermo-mechanical cooler and the liquid helium delivery assembly is coupled to a second stage of said thermo-mechanical cooler.

The first and second enclosures may beneficially define intermediate-temperature shields and a first plate may be provided over the liquid helium containing vessel to define an operating-temperature region for receiving a sample or specimen, in use.

In an embodiment, the cryogenic apparatus may further comprise a second plate thermally coupled to said second enclosure and proximate to said first plate. The apparatus may, optionally, further comprise a cover for removably covering said first and second plates, in use, and providing an air-tight seal with the second enclosure.

In an embodiment, the cryogenic apparatus may further comprise a removable probe assembly configured to be removably mounted over said second enclosure with an air-tight seal therebetween, the probe assembly comprising a housing configured at one end to provide said air-tight seal and provided, at the other end, with an opening for receiving a probe, in use, for introducing a sample into, or removing a sample from, an operating temperature region proximate to said liquid containing vessel.

In an embodiment, the housing may comprise an elongate, generally tubular member and the probe arrangement may further comprise a tubular duct that extends longitudinally through and along the length of the housing with an annular space defined between the tubular duct and the inner surface of the housing, the distal end of said tubular duct configured to be thermally coupled to said liquid helium containing vessel, in use. The apparatus may, optionally, comprise a first outer chamber within which said first enclosure is located, a second outer chamber within which said second enclosure is mounted and a rigid tubular bridge surrounding said tubular link member, the first and second outer chambers being coupled together by said rigid tubular bridge member and a fluid flow path being defined between said first and second outer chambers via an annular space between said tubular link member and the inner surface of the rigid tubular bridge, wherein, when said housing is mounted and sealed over said second outer chamber, said annular space is in fluid communication with said fluid flow path such that, in use, when air is extracted at the first outer chamber, the first and second outer chambers and the annular space between the tubular duct and the housing is evacuated.

In an embodiment, the apparatus may comprising an elongate probe configured to extend into said tubular duct through said opening, the probe comprising a plurality of spaced apart baffles of substantially equal diameter to the inner diameter of the tubular duct.

An isothermal shield may, beneficially, be provided around an end of the tubular duct nearest the end configured to provide said air-tight seal, the isothermal shield comprising a tubular sheath around said tubular duct and having a thermal link to said tubular duct at one end and being configured to be thermally coupled to said second enclosure, in use.

A gas curtain assembly may, optionally, be mounted around said opening, said gas curtain assembly being configured to introduce helium gas into said housing so as to prevent ingress of air to the sample space.

At least one viewing window may, beneficially, be provided in each of the isothermal shield and the tubular duct, near the second enclosure, when in use, the viewing windows being horizontally aligned when the apparatus is oriented for use, such that a specimen mounted on the probe within the tubular duct can be viewed.

In an embodiment, the probe may comprise a conductor housing at its distal end, the conductor housing including one or more wiring ports configured to enable diagnostic wiring to be connected thereto, in use.

These and other aspects of the invention will be apparent from the following Detailed Description.

BRIEF DESCRIPTION OF THE DRAWINGS

Embodiments of the present invention will now be described, by way of examples only, and with reference to the accompanying drawings, in which.

DETAILED DESCRIPTION

Figure 1B:
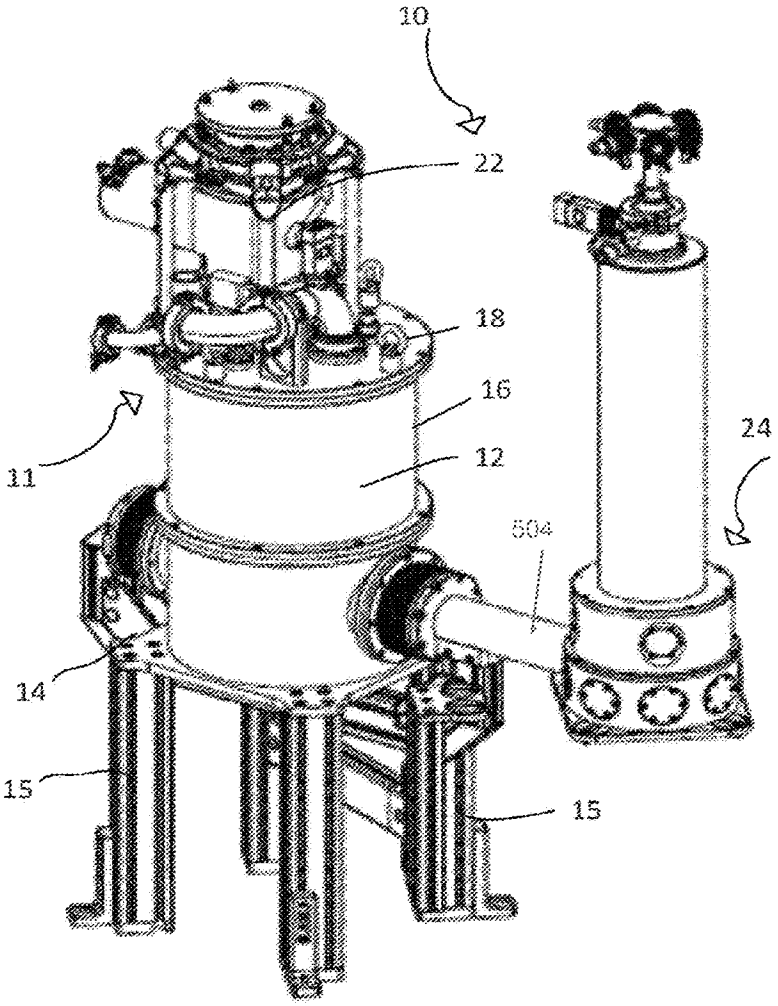
FIG. 1B is a schematic alternative perspective view of the cryogenic apparatus of FIG. 1A.
Figure 1A:
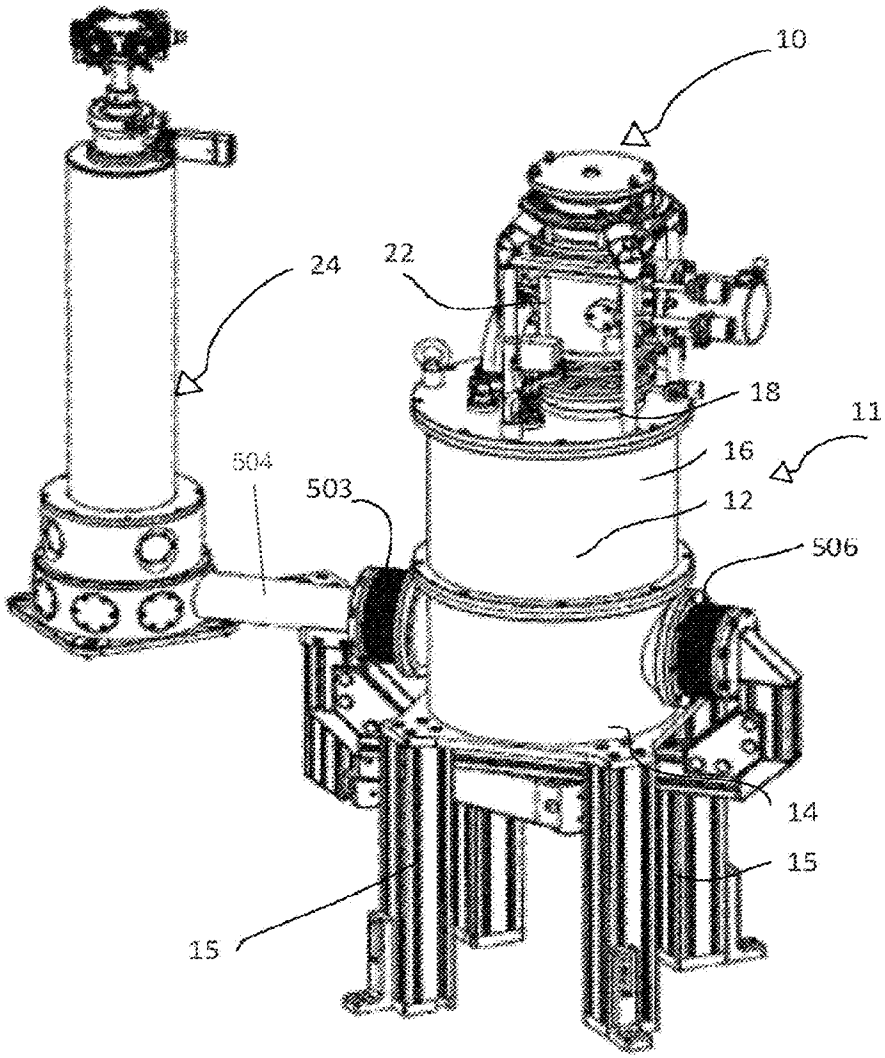
FIG. 1A is a schematic perspective view of a cryogenic apparatus according to an exemplary embodiment of the invention.
Figure 2A:
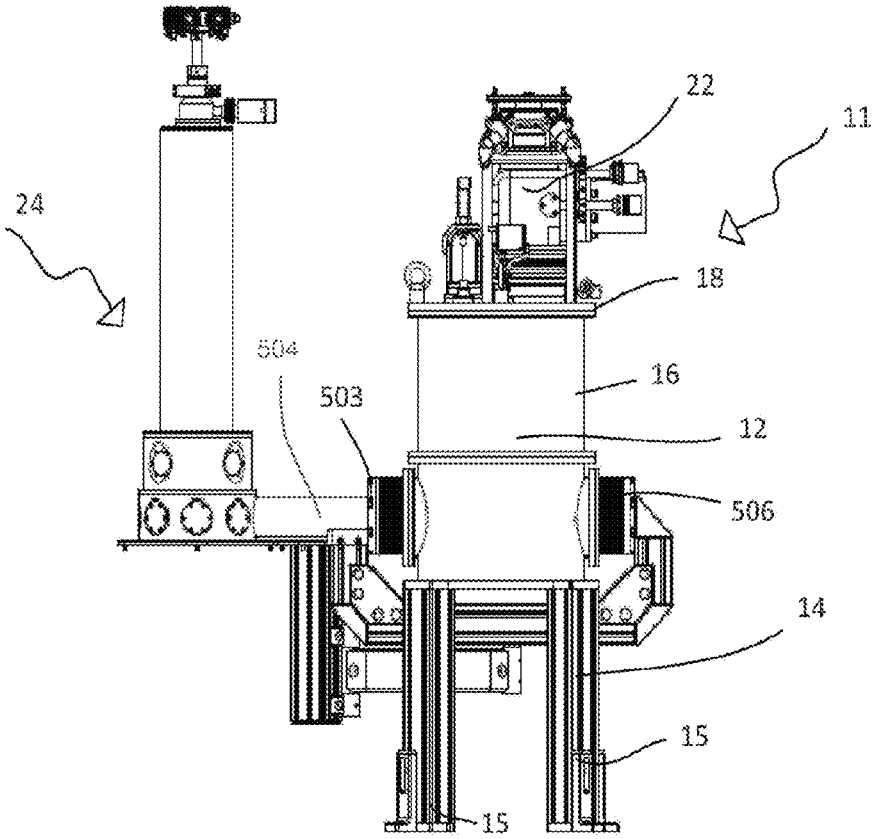
FIG. 2A is a schematic side view of the cryogenic apparatus of FIG. 1A.
Figure 2B:
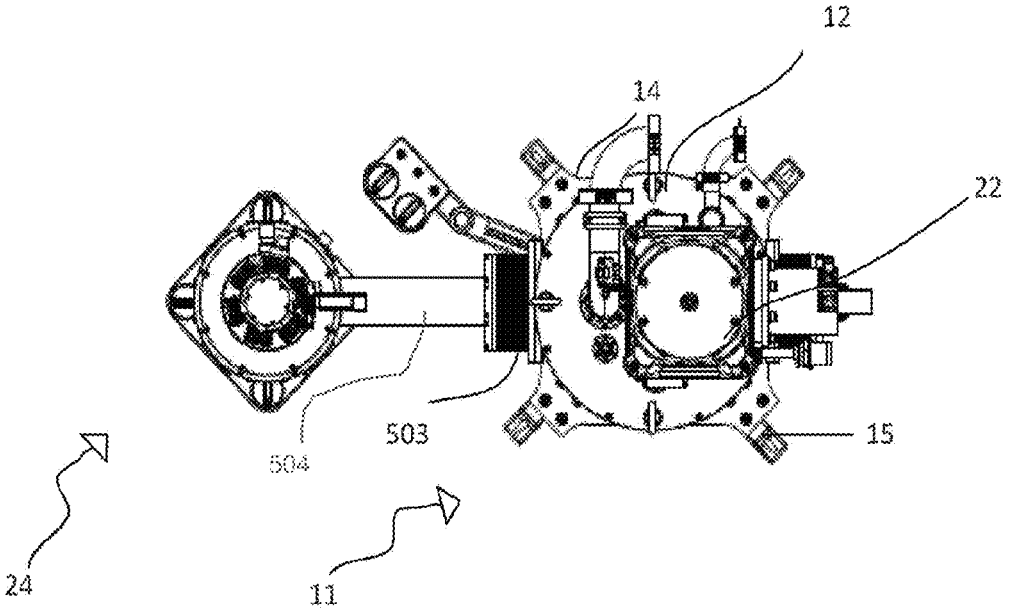
FIG. 2B is a schematic top view of the cryogenic apparatus of FIG. 1A.

Directional descriptors, such as upper, lower, left, right, clockwise, anti-clockwise, front, rear and other similar adjectives are used for clarity and refer to the orientation of the invention as illustrated in the drawings; however, it will be clear to those skilled in the art that the invention may not always be oriented as illustrated and the invention is not intended to be limited in this regard.

Referring to FIGS. 1A, 1B, 2A and 2B of the drawings, a cryogenic apparatus 10 comprises a cryocooler assembly 11 and an operating-temperature assembly 24, coupled together by a rigid bridge 504. The cryocooler assembly 11 comprises a cylindrical enclosure 12 with a base plate 14 which couples the enclosure to a support structure comprising, in this case, four elongate, rigid legs 15. The cylindrical enclosure 12 also comprises a cylindrical wall 16 and a top plate 18. Mounted on the top plate 18 is a two-stage cryocooler 22, and the top plate 18 is also provided with a port (not shown) so the enclosure 12 can be evacuated.

Figure 4A:
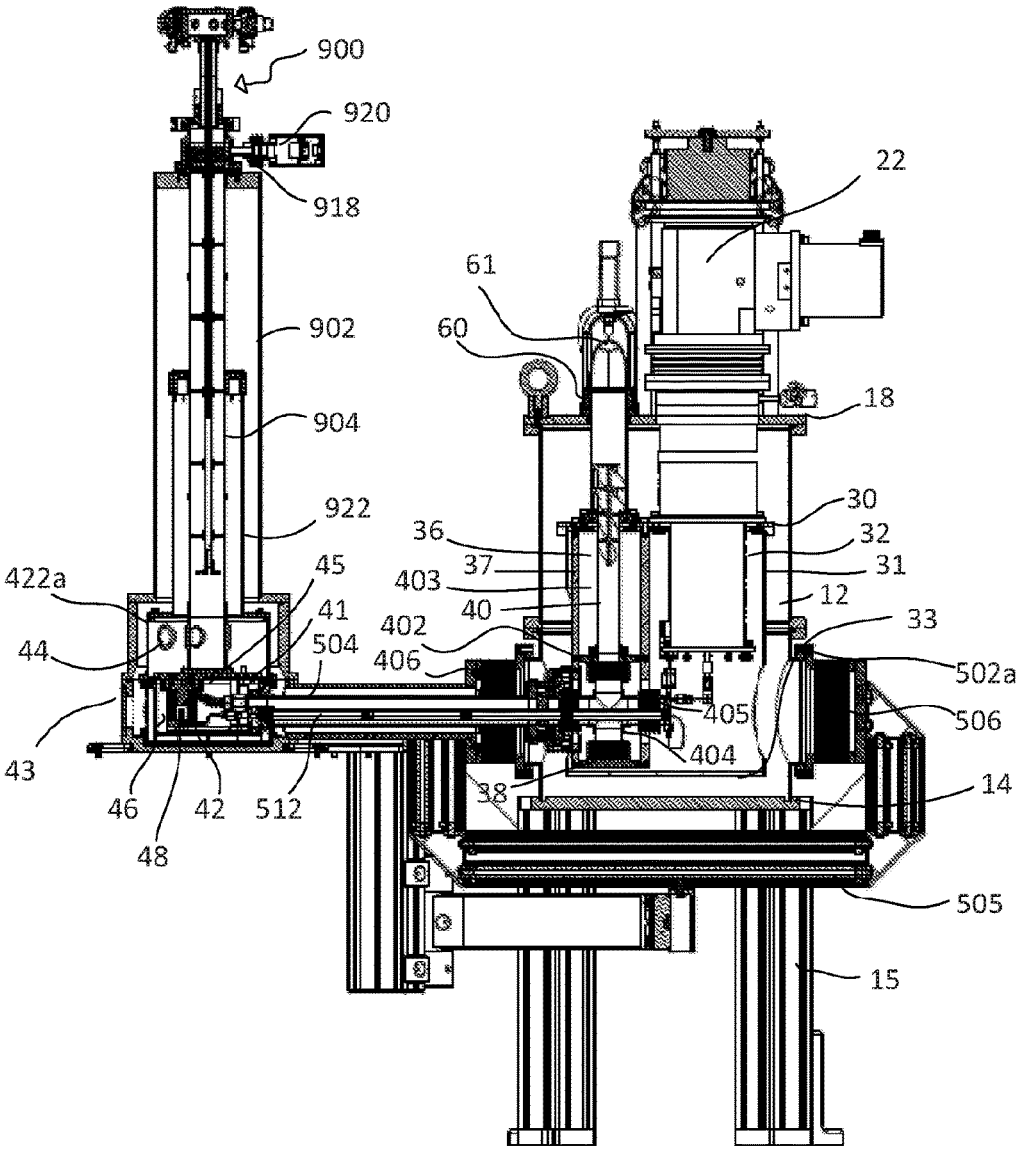
FIG. 4A is a schematic cross-sectional side view of a cryogenic apparatus according to an exemplary embodiment of the invention.
Figure 4B:
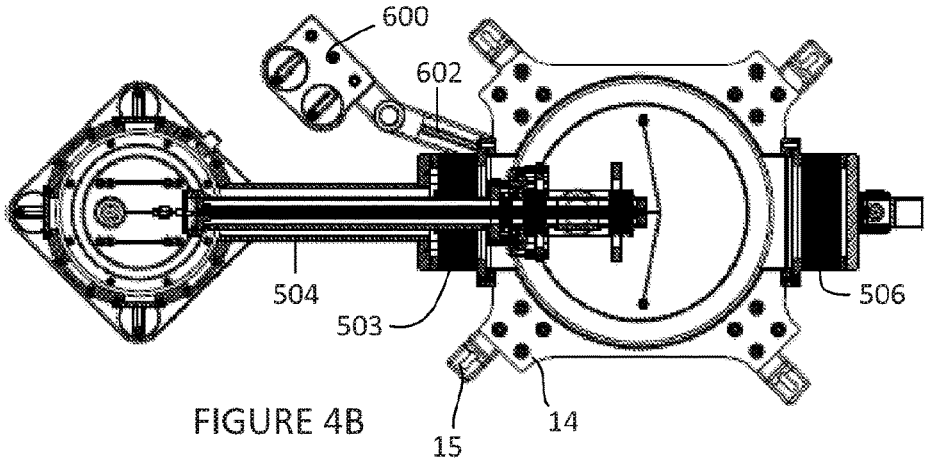
FIG. 4B is a schematic cross-sectional plan view of the cryogenic apparatus of FIG. 4A.

Referring additionally to FIGS. 4A and 4B of the drawings, within the enclosure 12, the lower end of the first stage of the two-stage cryocooler 22 is in thermal contact with a copper plate 30 which forms part of a cylindrical intermediate-temperature shield 32 with a thin cylindrical wall 31 and a base plate 33, the intermediate-temperature shield 32 being spaced-apart from, and enclosed within, the enclosure 12.

A pair of parallel, spaced-apart link intermediate-temperature link plates 37 extend downward from the lower surface of the copper top plate 30 to a base plate 38. Thus, the link plates 37, which are thermally coupled to the top plate 30 that is in thermal contact with the first stage of the cryocooler 22, act as intermediate-temperature links between the first stage of the cryocooler 22 and an intermediate-temperature (copper) shield having a thermally conductive tube 512 within the rigid bridge 504, as will be described in more detail hereinafter. As described below the rigid bridge may be formed of an elongate outer tube, and may therefore also be referred to as a "rigid tubular bridge," or simply a "bridge."

Figure 6:
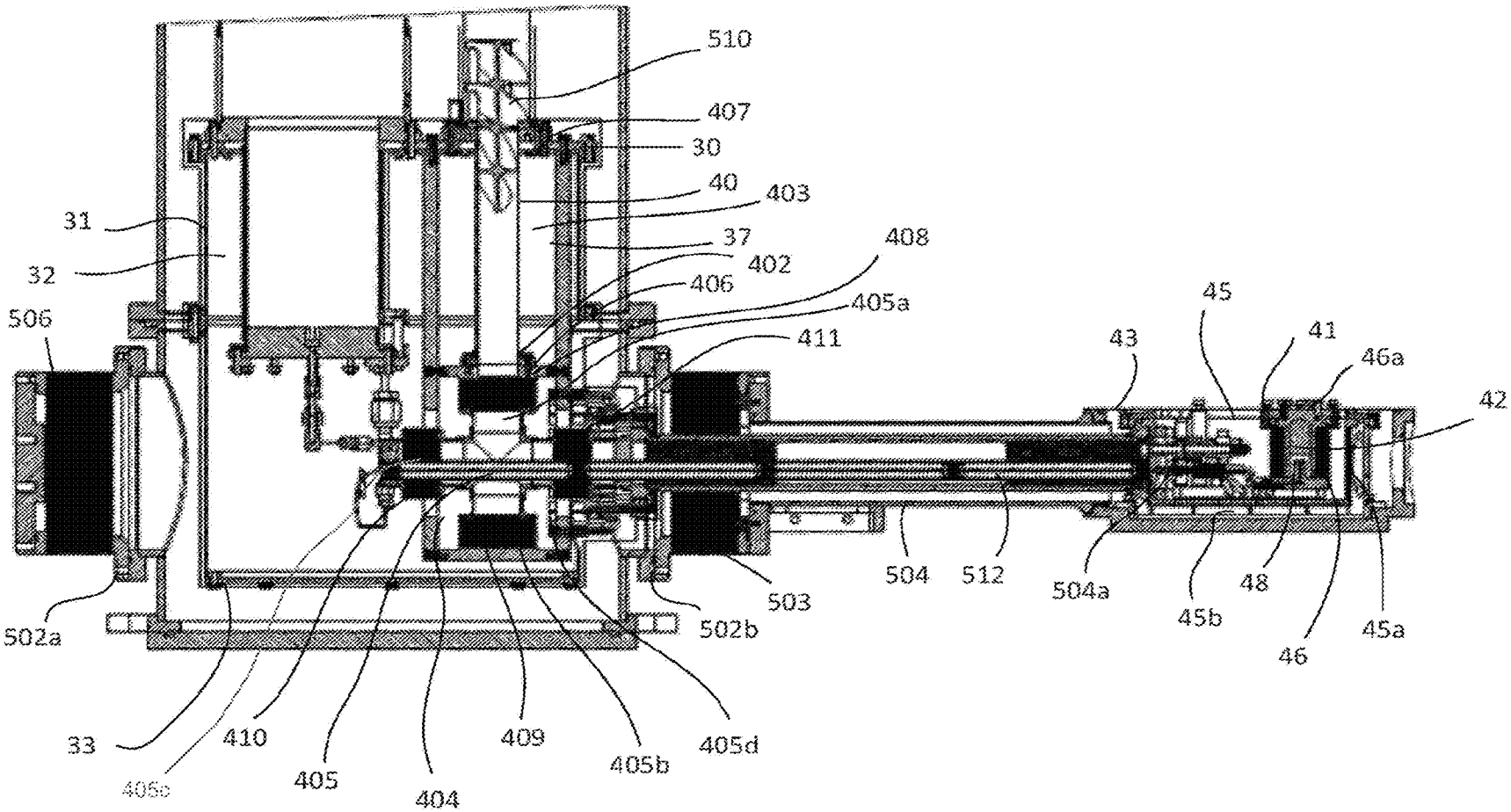
FIG. 6 is a schematic perspective cross-sectional view of a cryogenic apparatus according to an exemplary embodiment of the present invention; illustrating the helium delivery system and operating temperature assembly.

An intermediate wall 402 extends between the intermediate-temperature link plates 37 (parallel to, and longitudinally spaced apart from, the base plate 38) to define an upper region 403 and a lower region 404. Referring also to FIG. 6 of the drawings, a four- (or even six-) way cross fitting 405 is mounted in the lower region 404 and a gas flow duct 40 extends from a first port 405*a* of the cross fitting 405, coaxially within the lower region 404 between the link plates 37, through an opening 406 in the intermediate wall 402, coaxially within the upper region 403 and out through an opening 407 in the top plate 30, terminating in an outlet duct 60 connected to the 'upper' end of the gas flow duct 40 by means of an elbow joint 61. The gas flow duct can be selectively opened and sealed to, respectively, allow and prevent gas flow therethrough. As shown in FIG. 6, a radiation baffle 510 is mounted within the gas flow duct 40.

A first vibration-suppressing means (e.g. bellows) 408 is provided at the connection between the gas flow duct 40 to the intermediate wall 402 which forms the top plate of the lower region 404 between the intermediate-temperature link plates 37. A similar vibration-suppressing means (e.g. bellows 409 anchors the longitudinally (i.e. vertically) opposite port 405*b* of the cross fitting 405 to the base plate 38 at the base of the lower region 404 between the intermediate-temperature link plates 37.

One of the orthogonal ports 405*c* is coupled to a cylindrical end cap 79 (see FIG. 3) via a third vibration-suppressing means (e.g. bellows) 410. The end cap 79 comprises a short coaxial tubular element having a diametric end wall that has a small, off-centre opening 79*a* therein. The opposite orthogonal port 405*d* of the cross fitting 405 is anchored, via vibration-suppressing means (e.g. bellows) 411 to a thermally conductive (e.g. copper) tube 512 that is thermally linked to an intermediate-temperature link plate 37 by a coaxial set of heat exchange members 412. In this exemplary embodiment, the heat exchange members 412 may beneficially comprise a series of flexible braids of a highly thermally-conductive material, such as high purity copper, the braids being arranged in an equi-distant spacing and angularly offset configuration around the end of the thermally-conductive tube 512, as can be seen in FIG. 3B of the drawings.

Figure 3:
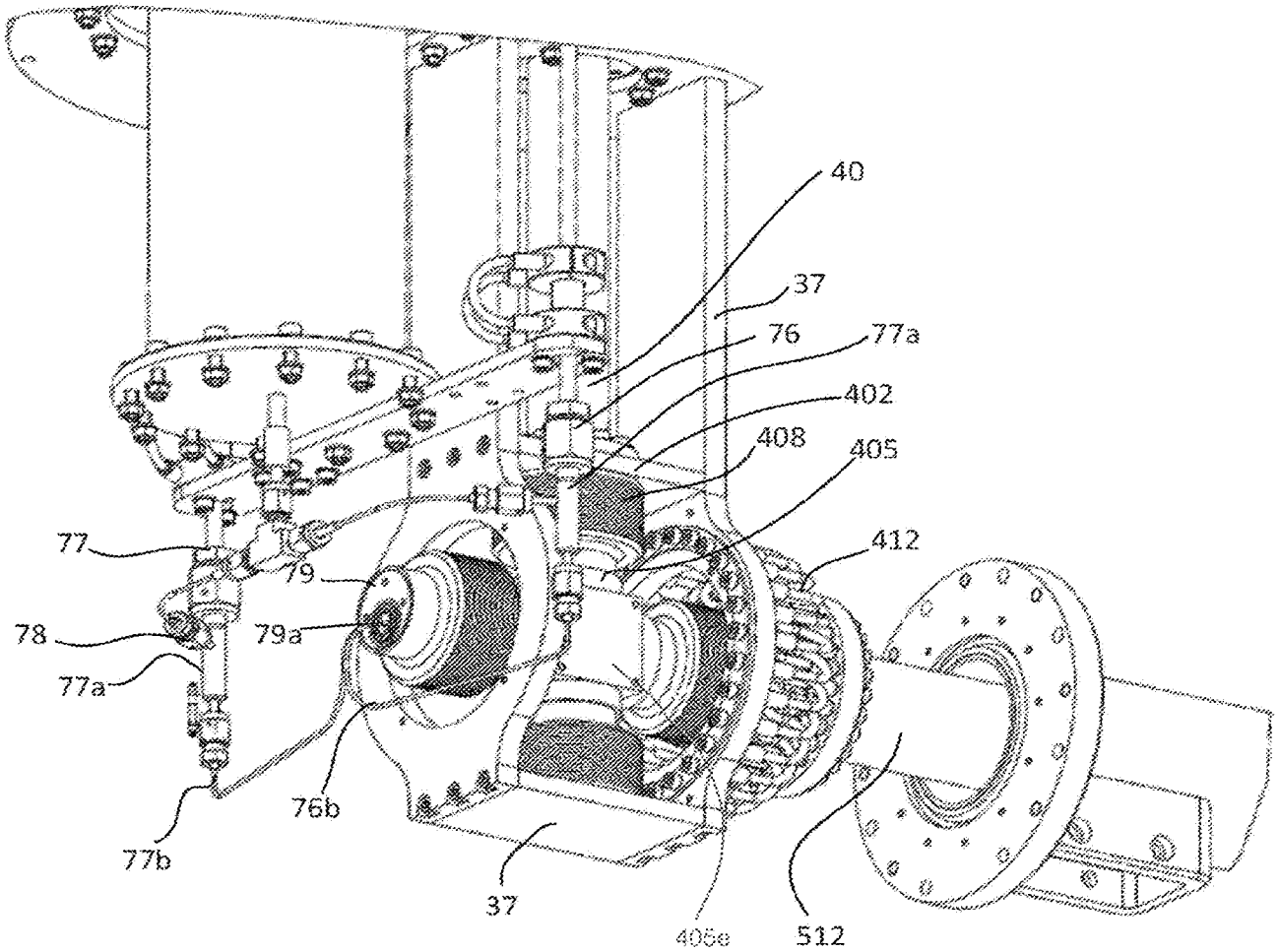
FIG. 3 is a schematic perspective view of a helium delivery arrangement of a cryogenic apparatus according to an exemplary embodiment of the invention.
Figure 3A:
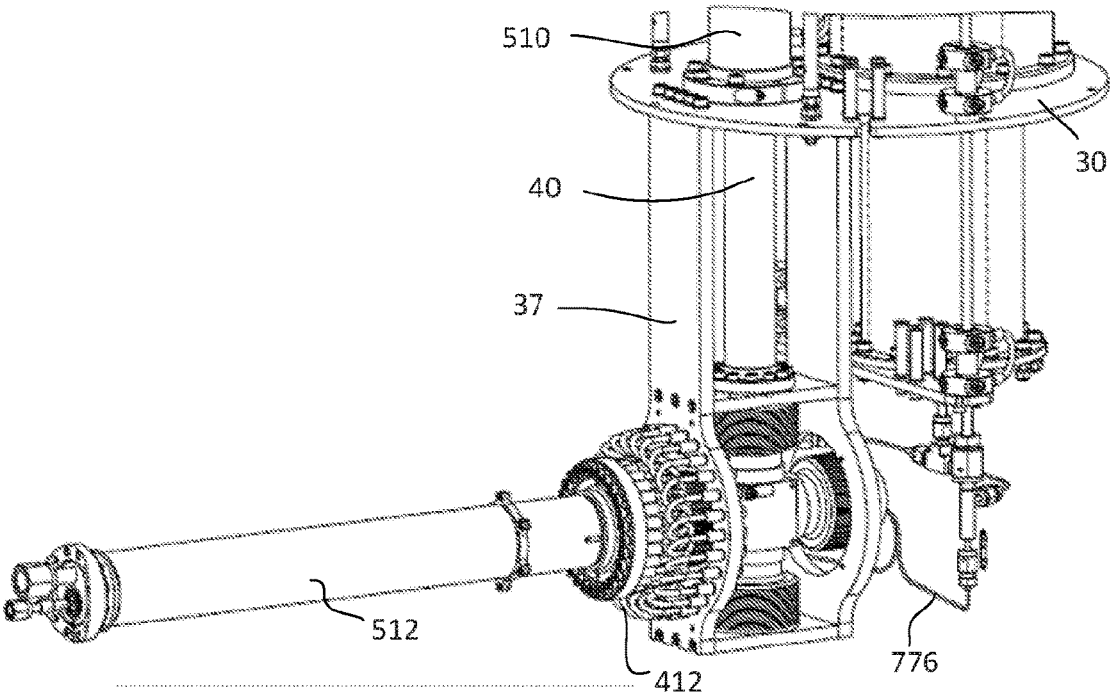
FIG. 3A is a schematic perspective view of a part of the cryogenic apparatus of FIG. 1 showing the first and second stages of the cryocooler and the, the helium delivery arrangement, the 50K link plates and the thermally conductive tube that extends through the rigid bridge.
Figure 3B:
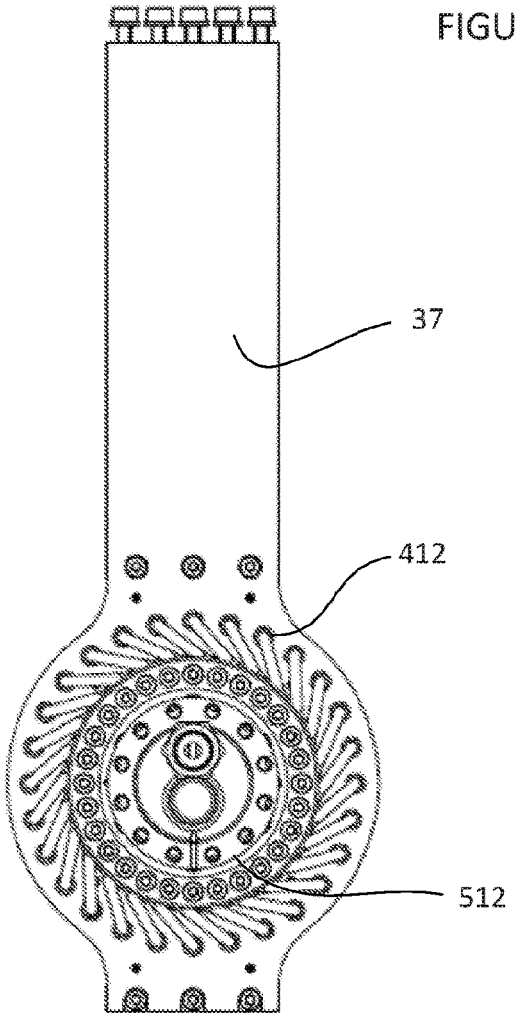
FIG. 3B is a schematic end view of a link plate and the heat exchange elements of the part of the cryocooler apparatus illustrated in FIG. 3A.

Referring additionally to FIG. 3A of the drawings, the cross fitting 405 may have only four ports; or, as shown in FIG. 3, there may be two additional ports 405*e* (only one shown) for connecting other components, such as a sorption pump (not shown) as required, which would be coupled to the respective port 405*e* of the cross fitting 405 via similar vibration-suppressing means (e.g. bellows). It will be understood by those skilled in the art that the vibration-suppressing characteristics of all of the vibration-suppressing means (e.g. bellows) used to couple elements of the apparatus to the cross fitting 405, as described above, will be substantially identical, thereby to act to cancel out any and substantially all vibrations arising from the first and second stages of the cryocooler 22 and also from the operating-temperature assembly 24 (to be described hereinafter).

Referring back to FIGS. 4A and 6 of the drawings, the cylindrical wall 16 of the enclosure 12 has two outlet ports 502 *a*, 502 *b*. A first outlet port 502 *b* has coupled thereto, via first vibration-suppressing means (e.g. bellows) 503, an elongate outer tube that forms the above-mentioned rigid bridge 504. As shown in FIG. 6 of the drawings, the arrangement of heat exchange members 412 is located adjacent to the first outlet port 502 *a* and the thermally conductive tube 512 forming the above-referenced intermediate-temperature shield extends coaxially through the rigid bridge 504 with the outer wall of the thermally conductive tube 512 being spaced apart from the inner surface of the rigid bridge 504 such that an annular space is provided between the two. The thermally conductive tube 512 terminates in a (e.g. stainless steel) washer 504 *a* (FIG. 6) coupled to a thermally conductive plate 41 within an enclosure 43 of the operating-temperature assembly 24. As described above, one end of the rigid bridge 504 is coupled, via vibration-suppressing means (e.g, bellows) 503 to the enclosure 12 of the cryocooler assembly 11. The other end of the rigid bridge 504 is coupled to (and in fluid communication with) the outer, generally cylindrical enclosure 43 referenced above. A generally cylindrical operating-temperature shield 45 is provided within the enclosure 43, and comprises a cylindrical wall 45 *a* and a base plate 45 *b*, wherein the above-referenced thermally conductive (e.g. copper) 'top' plate 41 is provided across the top of the cylindrical wall 45 *a*, spaced apart from and parallel to the base plate 45 *b*.

The second outlet port 502*a* of the enclosure 12 is coupled to one end of a rigid support arm 505 via a similar vibration-suppressing means (e.g. bellows) 506, the other end of the support arm 505 being bolted (or otherwise connected) to the rigid bridge 504.

Within the operating-temperature shield 45 there is provided a generally cylindrical vessel 42 comprising a cylindrical wall 46, extending 'downward' from the copper top plate 41, and a base plate 48. Thus, the thermally conductive top plate 41 of the operating-temperature assembly 24, which covers the operating-temperature shield 45 and the vessel 42, is thermally coupled to the intermediate-temperature (first) stage of the cryocooler assembly 11 via the thermally conductive tube 512 and washer 504*a*, the thermally-conductive tube 512 being thermally coupled, at one end, to an intermediate-temperature link plate 37 (of the cryocooler assembly 11) and, at the other end, via a thermally conductive washer 504*a*, to the copper top plate 41 of the operating temperature shield 45. The cylindrical vessel 42, in use, contains liquid helium.

Referring back, once again, to FIGS. 3 and 6 of the drawings, a needle valve assembly 50 is coupled to the low-temperature (second) stage of the cryocooler 22, the needle valve assembly 50 being configured to supply liquid helium to the cylindrical vessel 42. Helium is stored (in the cryocooler assembly 11) in a reservoir (not shown) typically at a pressure of about 11 kPA (about 1 bar) or less, and at about ambient temperature. The helium gas flows through a duct to the inlet of the cryocooler 22; this cools the gas to about 50K. The gas then flows through another duct to the second stage of the cryocooler 22, which cools the helium to about 4K, so liquid helium emerges from a first fluid supply assembly 76. A second fluid supply assembly 77 is thermally coupled to the second stage of the cryocooler 22 and the liquid emerging from the first fluid supply assembly 76 is split at a tee-joint 78 between the first and second supply assemblies 76, 77. Each fluid supply assembly 76, 77 includes a respective needle valve 76 *a*, 77 *a* and a narrow duct or 'capillary' 76 *b*, 77 *b* that extends through the off-centre opening 79 *a* in the end cap 79 and through the length of the thermally conductive tube 512 to the operating-temperature assembly 24, both capillaries 76 *b*, 77 *b* terminating within the cylindrical vessel 42. In some embodiments, the thermally conductive tube 512 is formed of copper. The needle valves 76 *a*, 77 *a* are used to control the outflow of pressurised liquid helium to the capillaries 76 *b*, 77 *b*. The capillaries 76 *b*, 77 *b* run through the thermally conductive tube 512 and, as liquid helium is fed therethrough (under further pressure from the needle valves) to the cylindrical vessel 42, it is cooled further. In some embodiments, the enclosure 42, also referred to as a "receptacle" or "pot", is cylindrical. By way of example, the liquid helium in the cylindrical vessel 42 may be around 1K.

This helium flow is brought about by a pump (not shown) which can extract helium gas from a return gas flow via the gas flow duct 40, and supply it to the reservoir. The pressure at the exit of the gas flow duct 40 may, for example, be less than 10 Pa (about 1 mbar) so that the liquid helium in the cylindrical vessel 42 evaporates below its normal boiling point, taking its latent heat from its surroundings, and in particular the copper support plate 41 (and hence from a specimen placed thereon or in close proximity thereto). The return helium gas flow is by way of the thermally conductive tube 512 to the gas flow duct 40.

Thus, as explained above, the cylindrical vessel 42 (containing liquid helium) is contained within a cylindrical operating temperature shield 45 which is typically about 1K, in use. The operating-temperature shield 45 and the vessel 42 are provided in the enclosure 43, also referred to as a receptacle or 'pot'. The copper top plate 41 is an intermediate-temperature (e.g., ~50K) plate. A second top plate 46 *a* is provided over the cylindrical vessel 42 and is an operating-temperature (e.g. ~1K) plate defining the surface or region by or on which a specimen or sample can be placed, in use. A removable cover (not shown) may be provided for covering the sample and enclosure 43 in use, and the cover may have 'windows' or viewing ports in its side walls to allow for viewing or imaging of the specimen or sample situated in or on the operating-temperature region.

As described above, the cryocooler 22 in this embodiment may be a two-stage Gifford-McMahon cooler, which uses high pressure helium at a pressure typically between 10 bar and 30 bar as the working fluid, in a closed circuit. The working fluid is provided by one or more external compressors (not shown). Each stage of the cryocooler 22 includes a cylinder with a movable displacer and a rotary valve to connect the cylinder alternately to high pressure and low pressure, and a mechanism to move the displacer(s) in synchronisation with the movement of the valve. Such coolers are commercially available products (e.g. Sumitomo Heavy Industries) and their details are not the subject of the present invention. Since the cryocooler 22 includes moving parts which operate typically at a frequency of about 1 Hz, the components that are subject to oscillation are isolated from the rigid bridge 504 by the respective arrangements of vibration-suppressing bellows 503, 506 and 408, 409, 410, 411 at the outlet ports 502 *a*, 502 *b* of the enclosure 12 and the ports 405 *a*, 405 *b*, 405 *c*, 405 *d* of the cross fitting 405 in the lower region 404 between the intermediate-temperature link plates 37. In use, liquid helium from the second stage of the cryocooler 22 is fed (via the capillaries 76 *b*, 77 *b*) to the cylindrical vessel 42 within the operating-temperature shield 45 of the enclosure 43. The copper thermally conductive tube 512 running through the rigid bridge 504 is thermally linked to the intermediate-temperature (e.g. 50K) link plates 37 such that it acts as an intermediate-temperature shield within the bridge 504. The return helium gas flow (described above) is via the same thermally conductive tube 512, which acts to help to maintain the temperature of the shield provided by the thermally conductive tube 512 such that no additional cooling thereof is required. Any vibration from the pump (not shown) in the operating-temperature assembly 11 is suppressed at the vibration-suppressing means 411 between the thermally conductive tube 512 and the port 405 *d* of the cross fitting 405. Helium gas thus returned can be fed back to the second stage (not directly) of the cryocooler 22, which cools the helium to about 4K (liquid helium) and it can be fed back through the needle valve assembly 50 and capillaries 76 *b*, 77 *b* to the cylindrical vessel 42 in the operating-temperature assembly 24. A superconducting magnet can be incorporated in the sample plate 46 *a* in some embodiments.

In use, and with the cover removed from the enclosure 43, a specimen or sample may be placed on or near the copper top plate 46 *a* and the cover (not shown) replaced such that there is an air tight seal between the cover and the enclosure 43. Then, the apparatus can be commissioned; first, by evacuating the enclosure 12, thereby evacuating the intermediate-temperature shield 32 and the intermediate-temperature shield 45 (via the bridge 504) and then starting the cooling process described above using the two-stage cryocooler and the liquid helium delivery system. In order to remove the specimen or sample, the cooling is switched off and the system warmed up. The cover can then be removed (thereby breaking the vacuum) and the sample or specimen accessed.

Figure 5A:
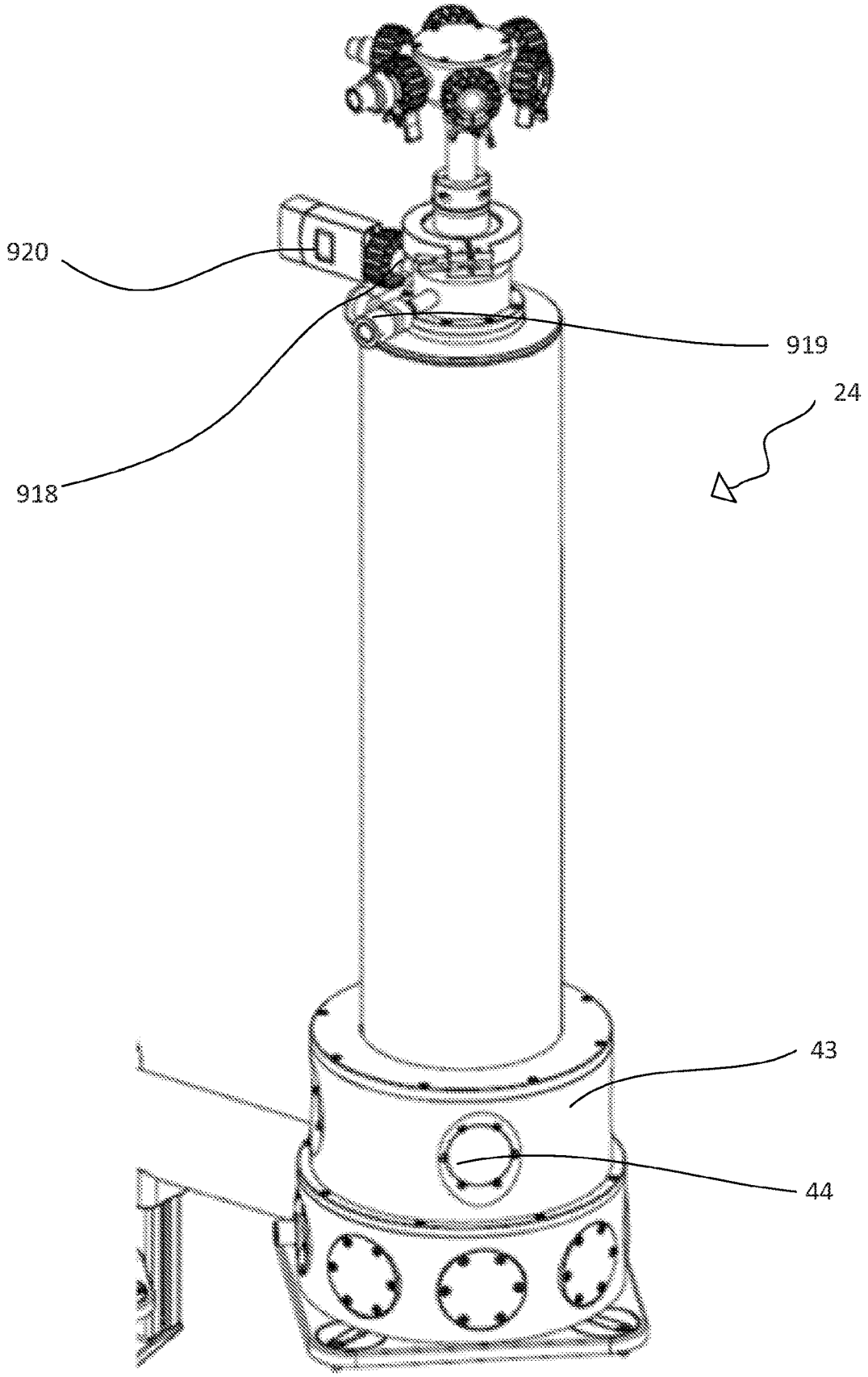
FIG. 5A is a schematic perspective view of an operating-temperature assembly and probe arrangement of a cryogenic apparatus according to an exemplary embodiment of the present invention.
Figure 5B:
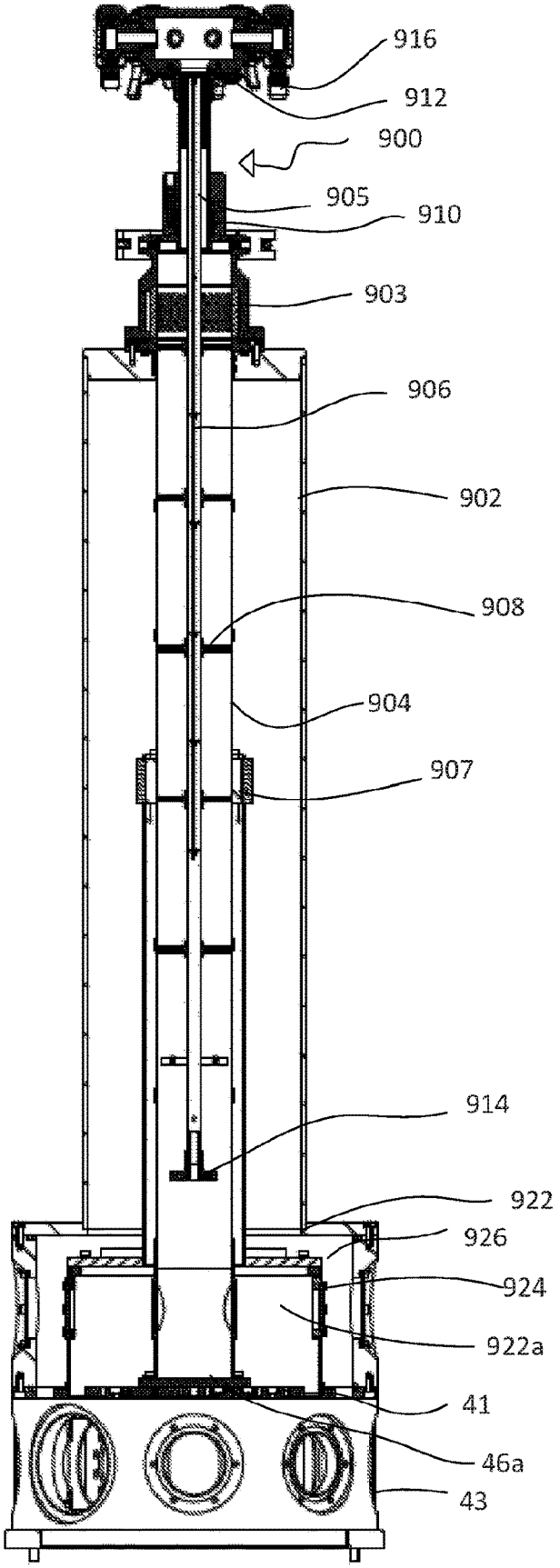
FIG. 5B is a schematic longitudinal cross-sectional view of an operating temperature assembly and probe arrangement of a cryogenic apparatus according to an exemplary embodiment of the present invention.

Referring back to FIGS. 4A and 4B, and additionally FIGS. 5A and 5B, in an alternative embodiment, there is provided a novel probe arrangement for use with the enclosure 43, or 1K pot, described above (instead of the above-referenced cover). The probe arrangement 900 is particularly advantageous because it enables a sample or specimen to be introduced into the operating-temperature (~1K) region within the enclosure 43 without having to warm up the system. The probe arrangement 900 comprises a cylindrical/tubular housing 902 that can be (removably) mounted on the enclosure 43 to provide an air-tight seal therebetween, such that the housing 902 defines an outer vacuum chamber (OVC) that is evacuated along with the intermediate-temperature shield 22 and the intermediate-temperature shield 45 when the apparatus is in use. The OVC 902 is of greater diameter at the bottom end (to match and accommodate the diameter of the nclosure 43) than at the top end. At the top end of the OVC 902, there is provided a gas curtain assembly 903 including an inlet port 919 and a pressure gauge 920 (see FIG. 5A). The gas curtain assembly 903 narrows to a small opening 905 through which a (e.g. carbon fibre) probe 906 extends, as will be described in more detail hereinafter.

The lower portion of the OVC 902 having a larger diameter includes viewing ports 924. Within the OVC 902, there is a tubular duct 904 that extends concentrically and longitudinally through the OVC 902 and is in thermal communication at its 'bottom' end with the operating temperature (~1K) support plate 46 *a*. An intermediate-temperature shield 922 is mounted around the 'lower' end of the duct 904, with the lower end 922 *a* being of a diameter substantially equal to the intermediate-temperature (~50K) plate 41 and being bolted (or otherwise affixed) thereto such that they are thermally coupled. The intermediate-temperature shield 922, which may, for example, be formed of thin copper, narrows along its length and terminates about half way up the length of the duct 904. The lower, larger diameter portion of the intermediate-temperature shield 922 has viewing ports 926, wherein the viewing ports 924 of the OVC 902 and the viewing ports 926 of the intermediate-temperature shield 922 are aligned with similar viewing ports in the duct 904 to provide a clear optical path such that viewing or imaging of a sample located in the 1K region is facilitated. There is a thermal link 907 between the upper edge portion of the tubular intermediate-temperature shield 922 and the adjacent outer surface of the duct 904. Helium gas can be pumped into the OVC 902 via the inlet port 918 of the gas curtain assembly 903 to lower the temperature therein. The intermediate-temperature shield 922 acts as a "thermal intercept" along the length of the probe arrangement 900 such that the temperature in the duct 904 is ~300K at the 'upper' end (adjacent to the gas curtain arrangement 903) and ~50K at the top of the intermediate-temperature shield 922. Then there is a temperature gradient along the length of the duct 904, within the intermediate-temperature shield 922, from 50K at the top of the intermediate-temperature shield 922 to ~1K at the operating temperature support plate 46 *a*. This is highly efficient, especially when inserting a specimen into, or removing a specimen from, the operating-temperature region of the enclosure 43, as described below.

A probe 906 is provided with a series of concentric baffles 908, spaced apart long its length, and a sliding seal flange 910 is provided close to the top of the probe 906 (when oriented for use). A conductor housing 912 is provided at the proximal (top) end of the probe 906 and a specimen mounting plate 914 is provided at the opposing distal (bottom) end. The conductor housing may include a number of wiring ports 916 to enable diagnostic wiring (and the like) to be connected. The gas curtain arrangement 903 incorporates a gas relief valve 918 and, in use, when the enclosure 12 is evacuated, so too is the operating-temperature assembly (via the tubular bridge 504). In use, the gas relief valve 918 can be used to release the vacuum and allow the probe to be removed from and inserted into the housing 902 so as to mount or remove a specimen relative to the support plate 46*a*, without having to stop and warm up the entire apparatus every time.

Figure 7:
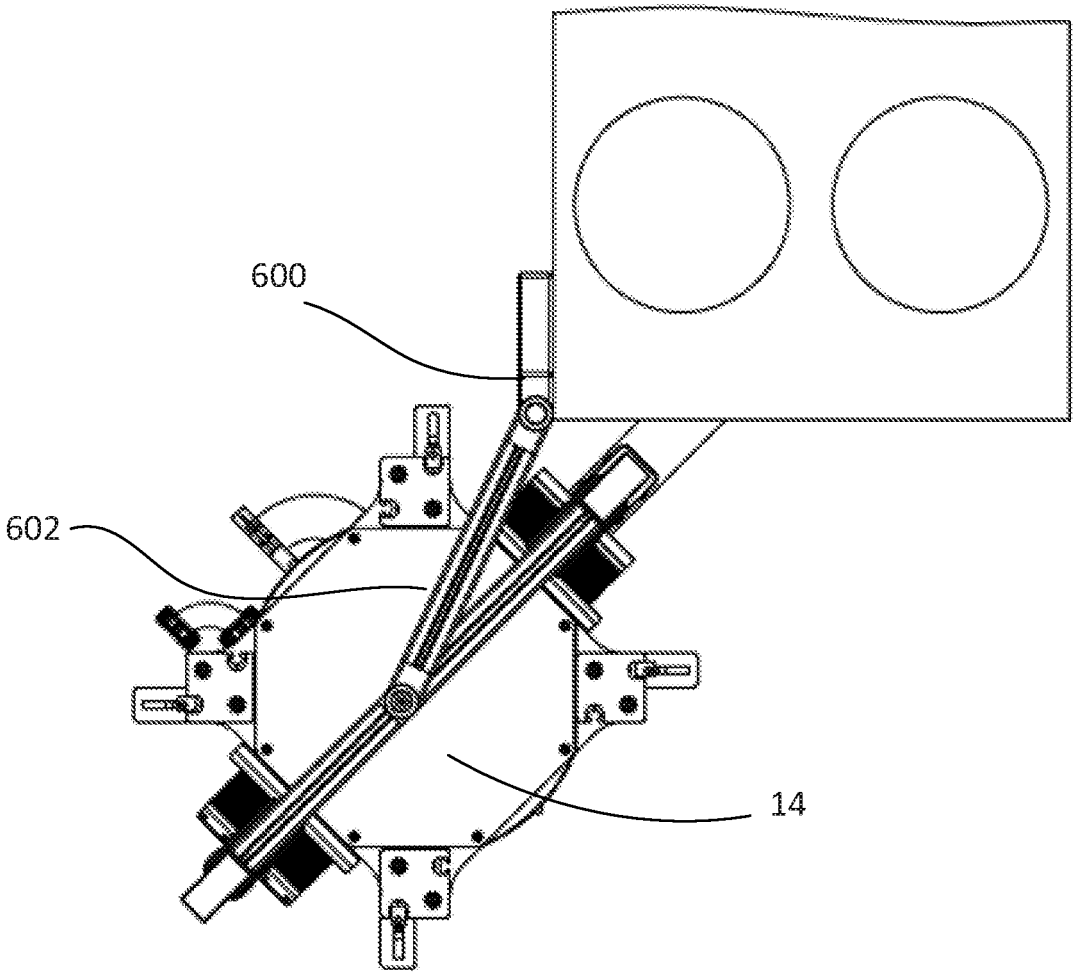
FIG. 7 is a schematic plan view of a cryogenic apparatus according to an exemplary embodiment of the present invention, illustrating the pivoting clamp arm operation.
Figure 8A:
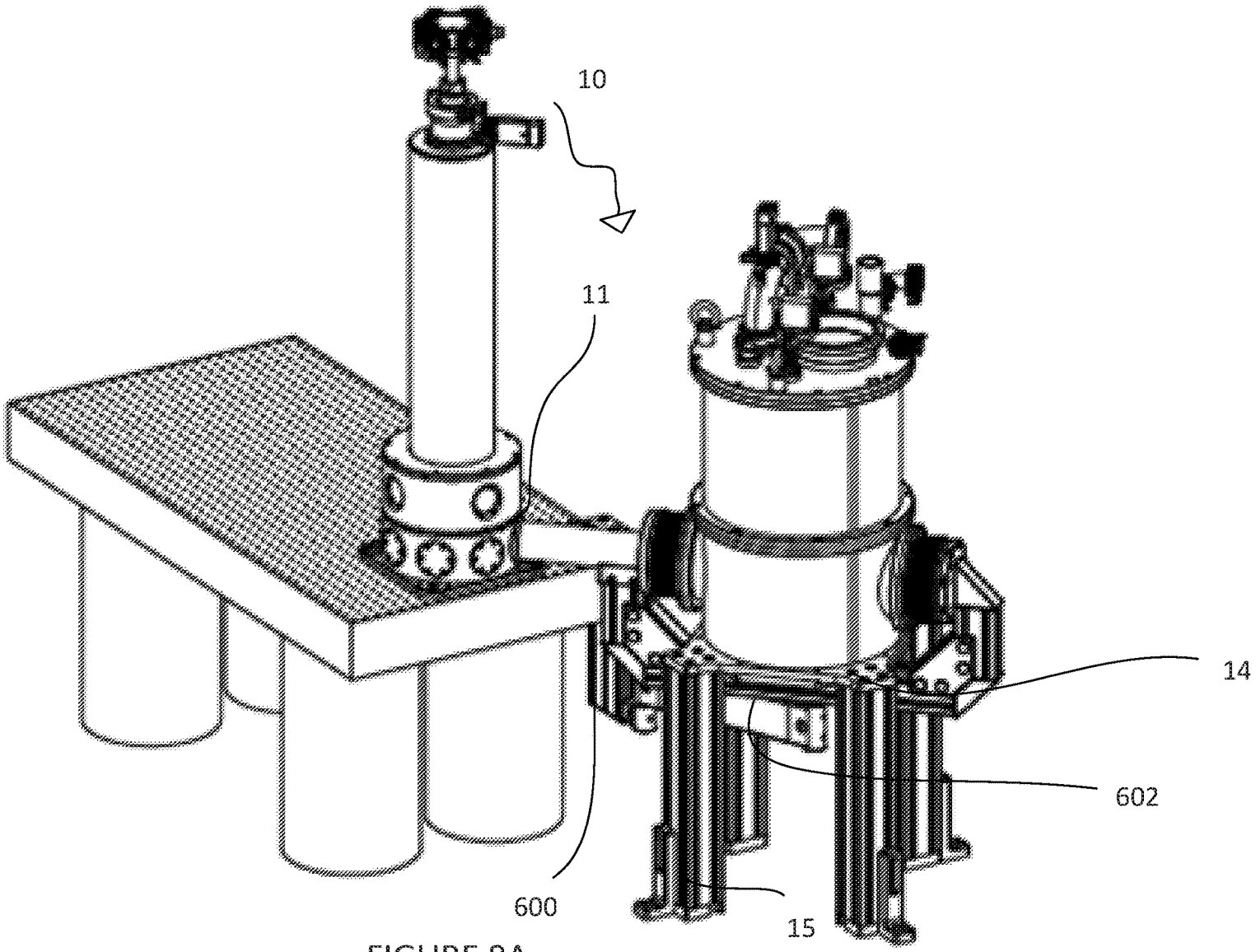
FIGS. 8A and 8B are schematic perspective views of a cryogenic apparatus according to an exemplary embodiment of the invention, shown from two different respective view angles.
Figure 8B:
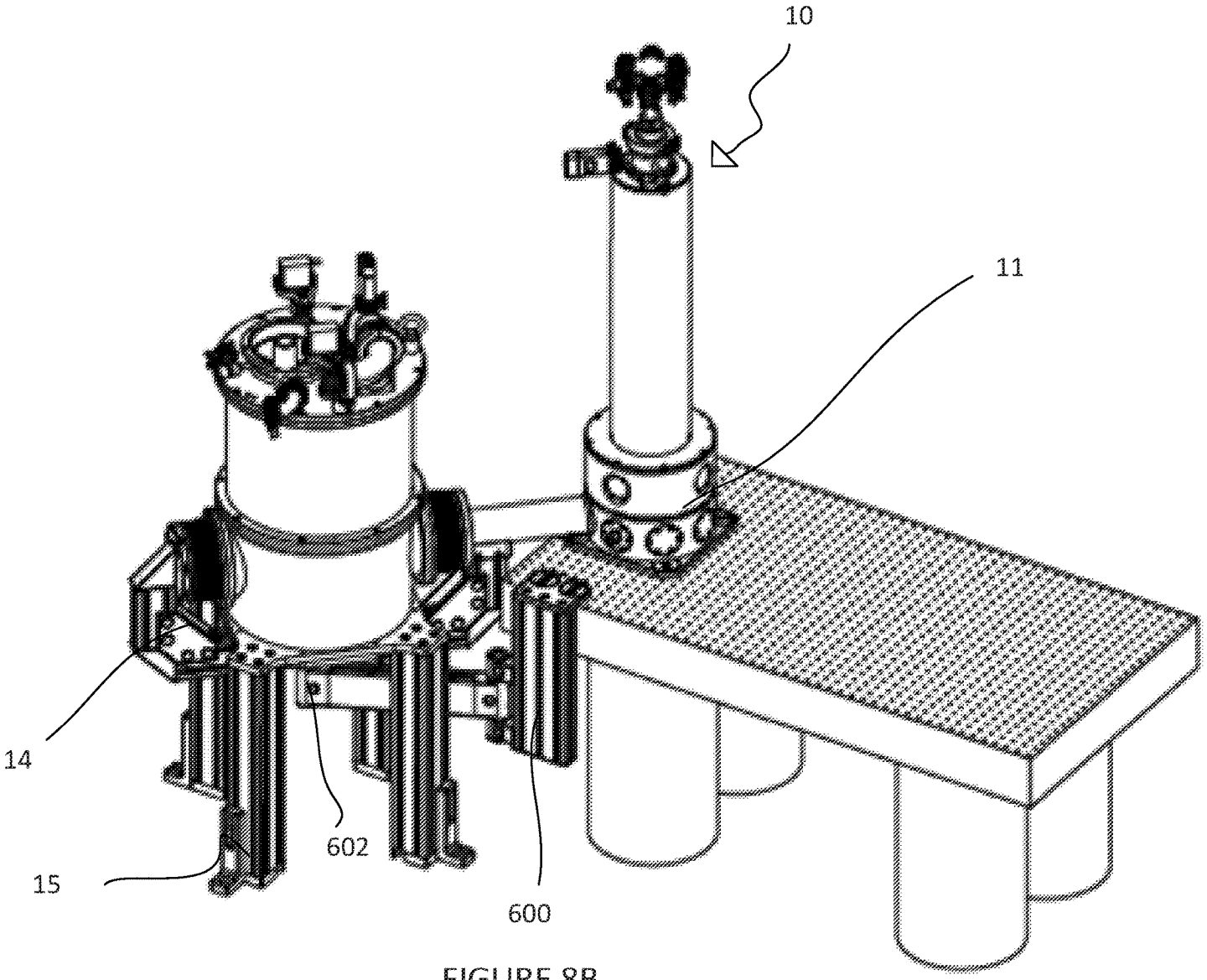
Figure 9A:
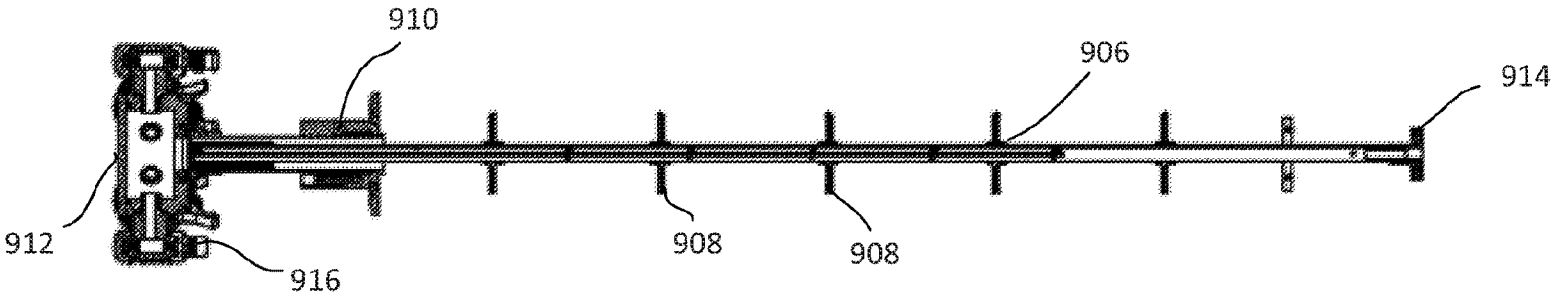
FIG. 9A is a schematic longitudinal cross-sectional view of a probe for a cryogenic apparatus according to an exemplary embodiment of the present invention.
Figure 9B:
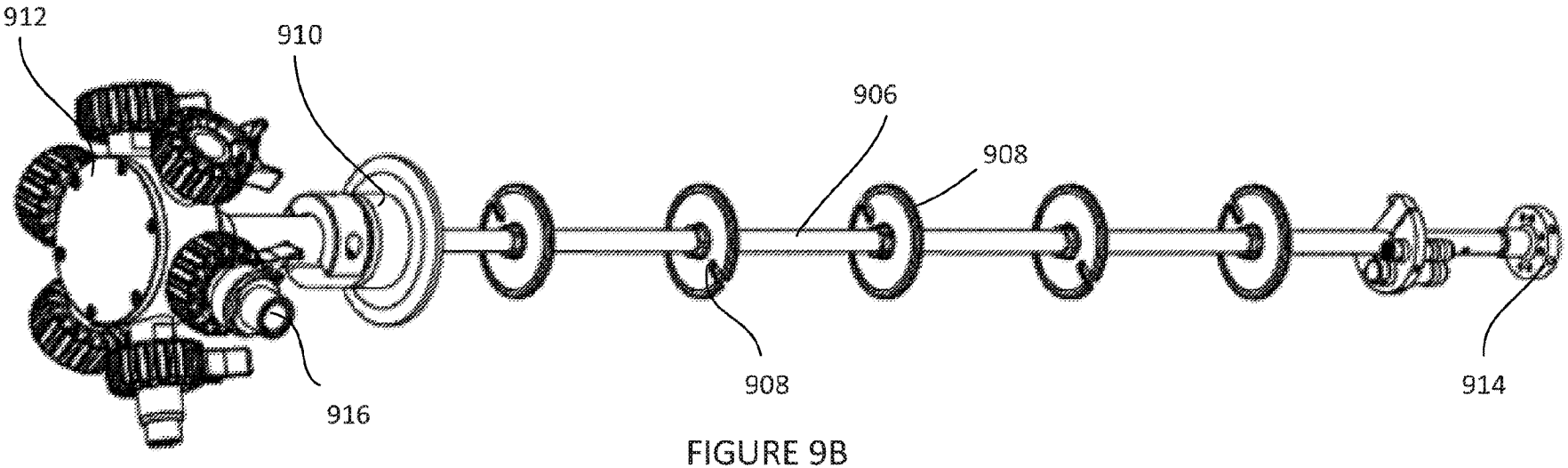
FIG. 9B is a schematic perspective view of a probe for a cryogenic apparatus.

Referring to FIG. 7 of the drawings, a clamp 600 may be provided, the clamp 600 being pivotally mounted to one end of a support arm 602, and the other end of the support arm 602 being pivotally coupled to the base plate 14 of the apparatus 10. Referring additionally to FIGS. 8A and 8B, the enclosure 43 having a 1K sample chamber can be mounted on, for example, an optical table at a variety of locations, using the pivoting clamp arrangement to brace the support arm 505. It will be appreciated that this is facilitated by the fact the 1K sample chamber can be physically separated from the rest of the apparatus because the vibration is isolated within the rest of the apparatus by the balanced internal bellows arrangement 408, 409, 410, 411 (in the lower region 44 between the intermediate-temperature link plates 37) and the balanced external bellows arrangement 503, 506. The novel probe arrangement 900 enables the 1K sample chamber to be loaded from the top, which is much more convenient, without completely decommissioning the apparatus and warming all the elements up.

It will be apparent to a person skilled in the art, from the foregoing description, that modifications and variations can be made to the described embodiments without departing from the scope of the invention as defined by the appended claims. For example, the apparatus may include other components, for example, a superconducting electromagnet to enable the specimen to be subjected to a magnetic field. The apparatus may also include sensors for a variety of parameters such as temperature and pressure within the helium recirculation path; and sensors (e.g. via the probe) for properties of the specimen.

The invention claimed is:

1. A cryogenic apparatus comprising:

a first enclosure;

a thermo-mechanical cooler thermally coupled to said first enclosure;

a second enclosure spatially distanced from, and thermally coupled to, the first enclosure;

an elongate tubular link member configured to thermally couple the first and second enclosures across the space between them;

a liquid helium containing vessel located in or proximal to said second enclosure for holding liquid helium, in use;

a liquid helium delivery assembly for delivering helium from said thermo-mechanical cooler to said liquid helium containing vessel;

a helium gas extraction duct configured to carry helium gas returned from said second enclosure, via said link member, to said thermo-mechanical cooler; and a connecting device located in said first enclosure and comprising a plurality of fluidly coupled ports, wherein a first port of said connecting device is coupled, via a first vibration-suppressing apparatus, to an end of said tubular link member, a second port of said connecting device is coupled, via a second vibration-suppressing apparatus, to an end of said helium gas extraction duct, and a third port of said connecting device is coupled, via a third vibration suppressing apparatus, to a wall of said first enclosure;

an outer vacuum chamber arrangement comprising a first outer chamber housing said first enclosure with a first circumferential air gap therebetween, a bridge member surrounding said tubular link member with a second circumferential air gap therebetween, and a second outer chamber housing said second enclosure with a third air gap therebetween;

wherein the first, second and third air gaps together define a fluid flow path;

wherein said thermo-mechanical cooler extends into said first outer chamber which has an evacuation port therein and the cryogenic apparatus further comprises a cover configured to seal said second outer chamber such that, in use, when air is extracted from said outer vacuum chamber arrangement via said evacuation port and said fluid flow path, a vacuum is created in said first and second enclosures;

wherein the bridge member is coupled, via a first external vibration-suppressing apparatus, to a first port provided in the first outer chamber; and wherein the first outer chamber comprises a second port and a support arm coupled, at one end via a second external vibration-suppressing apparatus, to the second port and, at the other end, to said bridge member at a location along the length of the support arm.

2. The cryogenic apparatus according to claim 1, wherein each vibration-suppression apparatus comprises bellows.

3. The cryogenic apparatus according to claim 1, wherein said liquid helium delivery assembly comprises at least one conduit that extends from the thermo-mechanical cooler, through said tubular link member, to said liquid helium containing vessel in said second enclosure.

4. The cryogenic apparatus according to claim 3, wherein said liquid helium delivery assembly comprises two substantially parallel capillaries that extend from said thermo-mechanical cooler, through said tubular link member, to said liquid helium containing vessel.

5. The cryogenic apparatus according to claim 4, wherein said liquid helium delivery assembly comprises a needle valve assembly between each of said capillaries and said thermo-mechanical cooler.

6. The cryogenic apparatus according to claim 3, further comprising a cylindrical end cap having an opening at one end and being coupled at the other end, via a fourth vibration suppressing apparatus, to a fourth port of said connecting device.

7. The cryogenic apparatus according to claim 1, wherein said thermo-mechanical cooler comprises a two-stage thermo-mechanical cooler, and wherein said first enclosure is coupled to a first stage of the thermo-mechanical cooler and the liquid helium delivery assembly is coupled to a second stage of said thermo-mechanical cooler.

8. The cryogenic apparatus according to claim 7, wherein the first and second enclosures defines intermediate-temperature shields and wherein a first plate is provided over said liquid helium containing vessel to define an operating-temperature region for receiving a sample or specimen, in use.

9. The cryogenic apparatus according to claim 8, further comprising a second plate thermally coupled to said second enclosure and proximate to said first plate.

10. The cryogenic apparatus according to claim 9, further comprising a cover for removably covering said first and second plates, in use, and providing an air-tight seal with the second enclosure.

11. The cryogenic apparatus according to claim 1, further comprising a removable probe assembly configured to be removably mounted over said second enclosure with an air-tight seal therebetween, the probe assembly comprising a housing configured at one end to provide said air-tight seal and provided, at the other end, with an opening for receiving a probe, in use, for introducing a sample into, or removing a sample from, an operating temperature region proximate to said liquid helium containing vessel.

12. The cryogenic apparatus according to claim 11, wherein said housing comprises an elongate, tubular member and the probe assembly further comprises a tubular duct that extends longitudinally through and along the length of the housing with an annular space defined between the tubular duct and the inner surface of the housing, the distal end of said tubular duct configured to be thermally coupled to said liquid helium containing vessel, in use.

13. The cryogenic apparatus according to claim 12, comprising;

a first outer chamber within which said first enclosure is located; and a second outer chamber within which said second enclosure is mounted and a tubular bridge surrounding said tubular link member, the first and second outer chambers being coupled together by said tubular bridge and a fluid flow path being defined between said first and second outer chambers via an annular space between said tubular link member and the inner surface of the tubular bridge, wherein, when said housing is mounted and sealed over said second outer chamber, said annular space is in fluid communication with said fluid flow path such that, in use, when air is extracted at the first outer chamber, the first and second outer chambers and the annular space between the tubular duct and the housing is evacuated.

14. The cryogenic apparatus according to claim 12, further comprising an elongate probe configured to extend into said tubular duct through said opening, the probe comprising a plurality of spaced apart baffles of equal diameter to the inner diameter of the tubular duct.

15. The cryogenic apparatus according to claim 12, wherein an intermediate-temperature shield is provided around an end of the tubular duct nearest the end configured to provide said air-tight seal, the intermediate-temperature shield comprising a tubular sheath around said tubular duct and having a thermal link to said tubular duct at one end and being configured to be thermally coupled to said second enclosure, in use.

16. The cryogenic apparatus according to claim 11, wherein a gas curtain assembly is mounted around said opening, said gas curtain assembly being configured to introduce helium gas into said housing.

17. The cryogenic apparatus according to claim 15, wherein at least one viewing window is provided in each of the intermediate-temperature shield and the tubular duct, near the second enclosure, when in use, the viewing windows being horizontally aligned when the cryogenic apparatus is oriented for use, such that a specimen mounted on the probe within the tubular duct can be viewed.

18. The cryogenic apparatus according to claim 14, wherein the probe comprises a conductor housing at its distal end, said conductor housing including one or more wiring ports configured to enable diagnostic wiring to be connected thereto, in use.

* * * * *